United States Patent [19]

Legge et al.

[11] Patent Number: 4,457,775

[45] Date of Patent: Jul. 3, 1984

[54] SALT-COATED MAGNESIUM GRANULES

[75] Inventors: Michael H. Legge, Tooele; John F. Charkson, Salt Lake City, both of Utah; William D. Bachman, Middletown, N.J.

[73] Assignee: AMAX Inc., Greenwich, Conn.

[21] Appl. No.: 496,350

[22] Filed: May 19, 1983

[51] Int. Cl.[3] ..... C22C 1/04

[52] U.S. Cl. ..... 75/0.5 B; 75/251; 75/252

[58] Field of Search ..... 75/0.5 B, 251, 252; 264/7

[56] References Cited

U.S. PATENT DOCUMENTS

| | | | |
|---|---|---|---|
| 3,969,104 | 7/1976 | Barannik | 75/0.5 B |
| 4,186,000 | 1/1980 | Skach, Jr. et al. | 75/0.5 B |
| 4,279,641 | 7/1981 | Skach, Jr. et al. | 75/0.5 B |
| 4,331,711 | 5/1982 | Skach, Jr. et al. | 75/0.5 B |

*Primary Examiner*—W. Stallard

*Attorney, Agent, or Firm*—Michael A. Ciomek; Eugene J. Kalil

[57] ABSTRACT

A process is provided for producing salt-coated spheroidal granules of magnesium by employing a molten flux bath comprised of a salt composition of NaCl, KCl and $CaCl_2$ maintained at a temperature in excess of the melting point of magnesium to which is added magnesium metal. A magnesium oxide dispersing agent is maintained in said bath in an amount sufficient for dispersing said magnesium. The bath mixture is subjected to high energy stirring sufficient to disperse the magnesium metal throughout the bath as beads. The bath mixture is then rapidly chilled to form a friable mass of the salt composition with spheroidal granules of magnesium dispersed through the salt matrix. The friable mass is then comminuted under conditions to release the magnesium from the salt as salt-coated spheroids which are thereafter recovered.

15 Claims, No Drawings

SALT-COATED MAGNESIUM GRANULES

This invention relates to a process for producing saltcoated magnesium granules having a spheroidal shape and to magnesium granules produced by the process.

BACKGROUND OF THE INVENTION

Magnesium granules, particularly salt-coated magnesium granules, are used in the iron and steel industry to effect desulfurization. As one example of this practice, iron blast furnace hot metal may be desulfurized by injecting salt-coated magnesium granules into the melt through a lance using flowing pressurized inert gas as a carrier. To insure that the granules flow freely through the lance, the granules are preferably rounded in shape, such as spheroidal. The terms "spheroid" or "spheroidal" used herein are meant to include such rounded shapes as spheres, ellipsoids of revolution, polygons with rounded corners, etc., that are characterized as being free flowing.

For convenience, the term "magnesium" shall be used hereinafter to cover magnesium per se and alloys based on magnesium.

According to U.S. Pat. No. 4,186,000, it has been known for many years in the electrolytic production of magnesium that the presence of boron as an impurity in the molten salt electrolyte is detrimental to the complete coalescence of magnesium formed during electrolysis. Because of the presence of boron, the magnesium not coalesced into a separate molten phase remains dispersed as droplets in the molten salt and in the cell sludge. When the cell salt or cell sludge is removed from the cell and freezes, the droplets of magnesium solidify into rounded granules trapped in the matrix of salt or sludge.

The problem of molten magnesium not coalescing during electrolysis can be partially alleviated by lowering the amount of boron contained in the feed materials charged to the electrolysis cells. Typically, the cell electrolyte generally contains less than 10 ppm (0.0010%) boron.

Further, the addition of fluorides (as $CaF_2$, NaF, etc.) to the cell electrolyte has been found to aid in the coalescing of molten magnesium. As Kh. L. Strelets points out in his book *Electrolytic Production of Magnesium* (translated from Russian to English by J. Schmorak, published in 1977 by Keter Publishing House Jerusalem, Ltd., available from the U.S. Department of Commerce), the mechanism of the fluoride effect is not clear, but fluorides do enhance the coalescence of drops of fused magnesium. Strelets states that most authors recommend the addition of 0.3–0.5% $CaF_2$ to the electrolyte.

The process described in U.S. Pat. No. 4,186,000 was developed to produce salt-coated magnesium granules for use as inoculants in steel making. Because all molten salt mixtures are not necessarily conducive for providing dispersed magnesium granules, the process comprises adding a boron-containing dispersing agent to the molten mixture of salt and magnesium. The molten mixture of salt and dispersed magnesium is cooled to solidification, suitably ground, and the magnesium granules separated from the fines such as by screening.

Attention is also directed to U.S. Pat. No. 4,279,641 which is a continuation-in-part of U.S. Pat. No. 4,186,000 but differs in that magnesium granules are produced without adding a dispersing agent but by carefully controlling salt compositions.

Materials other than boron can prevent coalescence of magnesium in a molten mixture of salt or sludge and magnesium and leave the magnesium in a dispersed state. Reding and Erickson ("Factors Controlling Melt Loss in Magnesium Die Casting", Paper No. 101, 6th SDCE International Die Casting Congress, Nov. 16–19, 1970) found an "... inability of the metal phase in sludge to coalesce because of the presence at the metal flux interface of products of reaction between the alloy and the die casting lubricant."

It has been observed that magnesium oxide can act to prevent coalescence of molten magnesium metal in a chloride salt melt. In Strelets, it is noted that the small amounts of magnesium oxide present in electrolytes tends to become concentrated on magnesium droplets. The number of tiny magnesium droplets increases and magnesium losses increase because the droplets become coated with magnesium oxide and do not coalesce.

Magnesium oxide in the electrolyte salt can arise inadvertently from many sources such as (1) being present in the cell feed materials, (2) reaction of magnesium or magnesium chloride with impurities, (3) burning of magnesium in air, and (4) reaction of air or moisture in the air with the salt electrolyte. Unless special precautions are taken with respect to equipment design and operating practice to avoid all of these sources of magnesium oxide, it may be present to a greater or lesser degree in melts of salt and magnesium metal. Thus, simply agitating a molten mixture of salt and magnesium to form tiny magnesium droplets may result in a stable dispersion of magnesium droplets in the salt matrix where magnesium oxide is inadvertently present. However, the results are not always consistent and the size of the droplets may vary over a broad range. A desirable average size is one ranging from about 10 mesh to about 100 mesh.

It would be desirable to provide a process for directly and efficiently producing spheroidal granules of magnesium over a wide range of conditions.

OBJECTS OF THE INVENTION

It is an object of the invention to provide a process for producing salt-coated magnesium granules having a spheroidal shape.

Another object is to provide as an article of manufacture salt-coated spheroidally shaped magnesium granules.

These and other objects will more clearly appear when taken in conjunction with the following disclosure and the appended claims.

SUMMARY OF THE INVENTION

We have found that the aforementioned objects can be achieved by preparing a molten metal chloride bath to which molten magnesium is added along with deliberate and sufficient additions of magnesium oxide. A suitable magnesium oxide for this purpose is commercially produced as a light-burned magnesite sold under the trademark Magox by Basic Incorporated of Cleveland, Ohio. A period of vigorous agitation of the molten mixture will then produce a dispersion of magnesium droplets in the molten salt matrix. After the magnesium droplets have reached the desired size range and the agitation is stopped, the magnesium droplets will not coalesce due to their being coated with magnesium oxide. In this manner, high yields of magnesium granules of substantially uniform size range are obtained by stabilizing the dispersed magnesium droplets with magnesium oxide. Subsequently in the process, the molten mixture of magnesium droplets and salt is solidified and the magnesium granules are recovered by suitable means of grinding the solidified mixture such that the salt is finely pulverized while the magnesium granules suffer little or no size reduction. The magnesium granules are recovered from the ground mixture such as by screening.

While the magnesium droplets will not coalesce after being formed by agitation and stabilized by magnesium oxide, the dispersion can exhibit the phenomenon described as "creaming" (American Chemical Society Monograph 162, *Emulsions: Theory and Practice,* 2nd Ed., Paul Becher, Krieger Publishing Company, Huntington, N. Y. 1977). In "creaming", the magnesium droplets, if they are sufficiently lighter than the molten salt which is present, will float to the top and collect in a layer. The relative population of droplets increases as they accumulate in the layer but if properly stabilized with magnesium oxide the droplets will not coalesce.

In a molten mixture of salt and magnesium which has been agitated sufficiently to form small droplets of magnesium dispersed in the salt, the resistance of the dispersion to coalescence is dependent on the net result of opposing actions caused by the presence in the melt of agents which promote coalescence (example: metal fluorides) and those which hinder coalescence (example: magnesium oxide). Thus, a melt which is high in fluorides will require relatively large additions of magnesium oxide if a stable dispersion is to be formed. Conversely, low-fluoride melts require less magnesium oxide to be present when forming stable dispersions. For ease of control as well as lower operating costs, low-fluoride melts (less than 0.4% or 0.5% by weight fluoride ion) are preferred. If a low-fluoride melt utilizes, in part, remelted salt recycled from another section of the process, a dosage of magnesium oxide to stabilize a dispersion may not need to be repeated for a number of cycles due to the carryback of this agent so long as the amount of magnesium oxide present is at least sufficient to provide a stabilized dispersion of spheroidal magnesium granules upon completion of high energy stirring. It is understood that combinations of other coalescing and dispersing agents will function in the same action-opposing manner as the fluorides and magnesium oxide chosen to illustrate the phenomenon.

Thus, one embodiment of the invention resides in a process for producing spheroidal granules of magnesium from a salt bath-magnesium mixture comprising a salt composition of substantially NaCl-KCl-$CaCl_2$ in which the magnesium oxide content of the salt composition is maintained at a level at least sufficient to provide a stabilized dispersion of said magnesium following completion of high energy stirring. The preferred amount of magnesium oxide is at least about 0.25% by weight of the salt bath mixture exclusive of the molten magnesium metal.

As stated hereinabove, the amount of magnesium oxide employed will also depend upon the amount of coalescing agents present, such as fluoride salts, e.g., $CaF_2$.

In situations where it is desirable to employ $MgCl_2$ as an additional salt addition, the presence of sufficient magnesium oxide is important as $MgCl_2$ tends to hinder dispersion of molten magnesium during stirring of the bath. This is particularly the case with amounts of $MgCl_2$ in excess of 20% by weight. Moreover, the addition of $MgCl_2$ has the propensity of raising the viscosity of the bath above the viscosity normally obtained with the NaCl-KCl-$CaCl_2$ salt bath composition alone. However, this can be alleviated by simply raising the temperature of the bath containing $MgCl_2$ to a level to bring its viscosity in line with that normally obtained with the NaCl-KCl-$CaCl_2$ bath composition. It is thus to be understood that baths containing substantial amounts of $MgCl_2$ would employ a higher temperature so that the viscosity of the bath is commensurate with that of $MgCl_2$-free salt baths.

An advantage of using $MgCl_2$ as part of the salt bath composition is its tendency to form MgO by oxidation or by reaction with moisture. However, it is not desirable to rely on $MgCl_2$ alone due to its inconsistency. It is thus important to maintain the MgO content of the salt bath deliberately at a level of at least about 0.25% by weight of the bath either by addition or by means of recycling previously used salt bath compositions, magnesium oxide being added, if necessary, to maintain it at the desired level in the salt bath.

One embodiment which may be employed in carrying out the invention resides in establishing a flux bath comprised of a salt composition of NaCl, KCl and $CaCl_2$ at a temperature in excess of the melting point of magnesium and salt, adding magnesium metal to the bath and magnesium oxide as a dispersing agent for said magnesium, the total bath mixture ranging by weight from about 10 to 35% magnesium (e.g., 15% to 25%), at least about 0.25% magnesium oxide by weight of the salt composition, and the balance essentially said salt composition, subjecting the bath mixture to high energy stirring sufficient to disperse the magnesium throughout the bath as spheroidal granules, rapidly solidifying the mixture to produce a friable mass with spheroidal granules of magnesium dispersed through the matrix thereof, comminuting the solidified mass under conditions to effect release of the magnesium granules from the salt matrix as salt-coated spheroids without substantially adversely affecting the free flowing properties thereof, and then separating and recovering said salt-coated magnesium spheroids from said comminuted salt matrix.

The foregoing process is advantageous in that the salt-coated spheroids produced have free flowing properties, particularly when the spheroids are employed as desulfurizing agents using a lance for injecting the granules into a steel bath.

DETAILS OF THE INVENTION:

A typical salt bath composition is one containing by weight about 50% NaCl, about 25% KCl and 25% $CaCl_2$. A preferred composition is one containing about 45% to 55% NaCl, about 20% to 30% KCl, and about 20% to 30% $CaCl_2$.

Broadly speaking, the composition may range from about 30% to 70% NaCl, about 10% to 35% KCl, and 10% to 35% $CaCl_2$.

Fluoride ions (e.g., alkali and alkaline earth metal fluorides, for example, $CaF_2$) may be present in amounts by weight up to about 1% so long as sufficient MgO is present to oppose the tendency for such fluorides to cause coalescence of dispersed magnesium metal following completion of high energy stirring, and so long as the amount of MgO at the higher range of fluoride ions is at least about 2.5% and, preferably, at least about 3% by weight of the salt bath composition.

The salt bath composition may be replaced by up to about 35% by weight of $MgCl_2$ for example, about 20% to 35%. At the upper range of the $MgCl_2$ content, substantial amounts of MgO (at least about 1% or 2%) should be used to assure a stabilized dispersion. At the same time a higher temperature should be employed to assure the desired viscosity.

The amount of MgO employed, depending upon the amount of coalescing agents present (such as $CaF_2$) may range as high as 3% by weight of the salt bath.

As illustrative of the various embodiments of the invention, the following examples are given.

EXAMPLE 1

To demonstrate the need for using MgO to produce an acceptable size range of spheroidal granules of magnesium, a series of foundry tests were conducted over a 24-hour period. The program was designed to show that periodic additions are required in order to produce magnesium beads of proper size distribution, that is, having a preferred average size distribution (U.S. Standard) ranging from about 10 mesh to 50 mesh, and more broadly from about 10 mesh to 100 mesh.

At the beginning of each cycle producing a batch of beads, the quantity of salt and magnesium added to the crucible was measured. The mixture was then agitated for 13 minutes, after which the bead layer was sampled so the size distribution could be determined. If the beads were small enough (i.e. if the +40 mesh fraction contained less than 15% to 20% + 10 mesh), the batch was processed. If the beads appeared too large, MgO was added while slow mixing for several minutes and the mixture then agitated for another 13 minutes. This was repeated until the beads were properly sized and the batch processed. The salt bath remaining after bead removal was sampled for chemical analysis and its reported composition is adjusted for entrained magnesium metal (Mg-free analysis). The temperature, agitator speed, agitation time, salt bath composition, and other parameters were kept as nearly constant as possible so that the only variable was MgO additions.

The chloride salt weighed 14,000 lbs. and the magnesium weighed 3,000 lbs., the total weight of the mixture being about 17,000 lbs.

As will be noted from Table 1 below, in some instances MgO was added and in others no MgO was added. The addition of 40 lbs. of MgO corresponds to about 0.29% by weight of the salt bath, while the addition of 20 lbs. corresponds to about 0.14% by weight of the salt bath, the amount added supplementing the amount of MgO already in the bath.

The standard foundry agitator used in production is a three-bladed propeller driven by an air motor. The tips of the blades are 9 inches from the center of rotation. Thus, using the following mathematical relation $$\text{Tip Speed} = 1.5\pi x \text{ RPM (ft/min.)}$$

it can be seen that the results in Table 1 were achieved at agitator tip speeds of less than 1000 ft/min.

TABLE 1

| | | | Salt-Coated Magnesium Granules | | | | | |
|---|---|---|---|---|---|---|---|---|
| | | Agitator | Mg-Free Salt (%) | | | Added | Bead Size Dist. (%) | |
| Batch | Temp. (°F.)* | RPM | NaCl | KCl | $CaCl_2$ | MgO (lbs) | +10 Mesh | −10 + 40 Mesh |
| 2-364-04 | 1330 | 192 | 52.0 | 23.5 | 24.5 | 0 | 10.2 | 89.8 |
| 2-364-05 | 1335 | 194 | 51.2 | 23.5 | 25.2 | 0 | 3.0 | 97.0 |
| 2-364-06 | 1330 | 202 | 52.1 | 23.1 | 24.8 | 0 | 14.5 | 85.5 |
| 2-364-07 | 1303 | 196 | | | | 0 | 72.1 | 27.9 |
| | 1303 | 196 | | | | 40 | 34.2 | 65.8 |
| | 1303 | 196 | | | | 40 | 29.1 | 70.9 |
| | 1303 | 206 | 52.1 | 23.4 | 24.5 | 40 | 5.9 | 94.1 |
| 2-365-01 | 1330 | 203 | 51.5 | 24.9 | 23.6 | 0 | 19.2 | 80.8 |
| 2-365-02 | 1334 | 190 | | | | 0 | 28.8 | 71.2 |
| | 1334 | 190 | 51.4 | 25.0 | 23.5 | 0 | 18.3 | 81.7 |
| 2-365-03 | 1321 | 194 | | | | 0 | 28.7 | 71.3 |
| | 1321 | 194 | 50.9 | 26.2 | 24.0 | 20 | 2.8 | 97.2 |
| 2-365-04 | 1332 | 190 | | | | 0 | 28.2 | 71.8 |
| | 1332 | 190 | 51.7 | 24.7 | 23.6 | 40 | 17.4 | 82.6 |

*Average temperature about 1322° F. or 717° C.

It will be noted from the table that when MgO additions are discontinued, the melt is depleted of this component and the bead size gets coarser in each succeeding batch. This is best demonstrated in batch sequence 2-364-05, 2-364-06, and the first agitation period of 2-364-07 in which beads were very large.

If a batch of beads is too coarse, the situation can be remedied by adding MgO to the batch and re-agitating to reduce the bead size. Batch 2-364-07 illustrates this point well in which the beads get finer with each 40 lb. addition of MgO.

As the data demonstrate, not every batch of beads needs a fresh addition of MgO. An excess of MgO in one batch can leave behind enough of this component in the molten salt remaining after bead removal to satisfy the next batch. Also, recycling and remelting salt from the grinding and screening circuit recirculates MgO-bearing salt which reduces the need for fresh additions. However, by using bead size as a gage during production, the addition of more MgO is indicated as the average bead size gets larger and larger. Thus the observation of bead size may be employed as a production tool.

EXAMPLE 2

This example illustrates the use of magnesium oxide for stabilizing dispersions of magnesium when a large amount of $MgCl_2$ is present together with $CaF_2$. The molten salt bath weighed 154 lbs. and had the following composition by weight:

TABLE 2

| $MgCl_2$ | NaCl | KCl | $CaCl_2$ | $CaF_2$ |
|---|---|---|---|---|
| 30.9% | 41.7% | 16.4% | 9.8% | 1.3% |

To the bath was added 50 lbs. of magnesium giving a total charge by weight of 24.5% magnesium and 75.5% salt bath.

This test was carried out in a test furnace using a small, three-bladed, air powered agitator. The tips of the blades were 2.75 inches from the center of rotation. The charge was agitated for 10 minutes at 1050 rpm (tip speed 1512 ft/min). After agitation had stopped, it was noted that the dispersed drops of magnesium ranged from about ⅛" to 1" in size which immediately coalesced into many large pools.

With slow agitation, 1600 grams MgO (3.527 lbs.) were then added to the charge and mixed for 5 minutes. Thereafter the charge was agitated for 12 minutes at 1075 rpm (tip speed 1548 ft/min) which resulted in a stable dispersion of magnesium beads. About 96% of the beads were smaller than 10 mesh (U.S. Standard). No coalescence was noted. The amount of MgO added by weight of the salt composition plus the weight of MgO (154+3.527) corresponds to about 2.24% by weight of the salt mixture.

It is preferred that the amount of fluoride ion when present not exceed about 0.4% by weight of the salt composition.

When the magnesium has been completely dispersed, the molten salt-magnesium mixture is solidified by casting it against a chilled surface, such as by pouring the molten bath mixture against a continuous steel belt water cooled on its underside to thereby form frozen friable pieces of the salt having granules or beads of magnesium dispersed therethrough.

The solidified salt is then fed to a flake breaker, e.g., a hammer mill where it is broken to nominal ¾ inch sizes. Following breaking, the material is fed to a cage mill and from there to an air classifier to remove the fines (primarily salt). The coarser material from the air classifier is sent to screens for final sizing and recovery of the magnesium granules.

While the use of a hammer mill may be preferred in breaking the friable mass of the solidified salt, any means of comminution may be employed so long as the comminuting conditions are such that the spheroidal integrity of the magnesium granules is not destroyed, such as by flattening, etc. In other words, the grinding conditions should be such as to liberate the spheroidal granules from the salt matrix substantially intact.

It is to be understood that the expression "spheroidal granules of magnesium of average size ranging from about 10 to 100 mesh" includes spheroids having sizes above 10 mesh and some having sizes below 100 mesh so long as the average of all the sizes ranges from about 10 to 100 mesh. For example, the size distribution may include up to about 20% by weight of granules in excess of 10 mesh so long as the average size of all the granules ranges from about 10 mesh to 100 mesh.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. In a process for dispersing magnesium in a molten salt bath containing said magnesium, said salt bath comprising a composition of NaCl-KCl-$CaCl_2$ maintained at a temperature above the melting point of said magnesium, the improvement which comprises maintaining in said salt bath an amount of MgO at least sufficient to form a substantially stable dispersion of magnesium beads following high energy stirring, and solidifying said bath mixture to form a friable mass having substantially spheroidal granules of magnesium of average size ranging from about 10 to 100 mesh (U.S. Standard) dispersed therethrough capable of being separated from said friable mass by comminution.

2. The process of claim 1, wherein the amount of MgO maintained in said salt bath is at least about 0.25% by weight of said salt bath.

3. The process of claim 1, wherein the amount of MgO is maintained in said bath by adding MgO to said bath.

4. The process of claim 1, wherein fluoride salts present do not exceed about 0.5% by weight of said salt bath.

5. The process of claim 1, wherein the amount of magnesium present ranges by weight from about 10% to 35% of the salt bath-magnesium mixture.

6. The process of claim 1, wherein the salt bath composition contains by weight 30% to 70% NaCl, about 10% to 35% KCl and about 10% to 35% $CaCl_2$.

7. The process of claim 6, wherein said salt bath contains by weight up to about 35% $MgCl_2$.

8. The process of claim 7, wherein the amount of $MgCl_2$ ranges from about 20% to 35% and the amount of MgO is maintained at a level of at least about 1% by weight.

9. The process of claim 1, wherein following solidification of the bath mixture, the friable mass is comminuted to release said spheroidal granules of magnesium from the salt composition and the granules thereafter separated from said salt.

10. A process for producing salt-coated spheroidal granules of magnesium which comprises, establishing a molten flux bath comprised of a salt composition of NaCl, KCl and $CaCl_2$ at a temperature in excess of the melting point of magnesium, adding magnesium metal to said bath and magnesium oxide as a dispersing agent for said magnesium, the total composition of the mixture ranging by weight from about 10% to 35% magnesium, at least about 0.25% magnesium oxide, and the balance substantially said salt composition, subjecting said bath mixture to high energy stirring sufficient to disperse said magnesium throughout said bath, rapidly chilling said bath mixture to form a friable mass of said salt composition with spheroidal granules of magnesium dispersed through said friable mass, comminuting said friable mass under conditions to release said magnesium granules from the salt matrix as salt-coated spheroids, and then separating and recovering said salt-coated magnesium spheroids from said comminuted friable mass.

11. The process of claim 10, wherein the composition of the salt bath ranges by weight from about 30% to 70% NaCl, about 10% to 35% KCl, and about 10% to 35% $CaCl_2$.

12. The process of claim 11, wherein the amount of magnesium oxide added as a dispersing agent ranges up to about 3%.

13. The process of claim 11, wherein the bath mixture following stirring is rapidly cooled by pouring said bath mixture against a chilled surface to produce rapidly solidified friable pieces of said salt composition which is thereafter comminuted by hammer milling.

14. As an article of manufacture, salt-coated magnesium spheroids of average particle size ranging from about 10 to 100 mesh produced in accordance with the process of claim 1, the coating of said spheroids also containing magnesium oxide.

15. An an article of manufacture, salt-coated magnesium spheroids of average particle size ranging from about 10 to 100 mesh produced in accordance with the process of claim 10, the coating of said spheroids also containing magnesium oxide.

* * * * *